United States Patent [19]

Si-Lin

[11] Patent Number: 4,929,346

[45] Date of Patent: May 29, 1990

[54] VIBRATORY SEPARTOR SCREEN ASSEMBLY

[76] Inventor: Yu Si-Lin, No. 67, 38th Alley, Kuang-Fu Rd., Sec. 2, San-Chung City, Taiwan

[21] Appl. No.: 145,912

[22] Filed: Jan. 20, 1988

[51] Int. Cl.[5] ..... B07B 1/28

[52] U.S. Cl. ..... 209/323; 209/403; 209/405

[58] Field of Search ..... 209/323, 403, 370, 401, 209/391, 405; 160/179, 380

[56] References Cited

U.S. PATENT DOCUMENTS

| | | | |
|---|---|---|---|
| 1,184,265 | 5/1916 | Schmits | 160/380 |
| 2,151,986 | 3/1939 | Olander | 209/370 X |
| 2,304,325 | 12/1942 | Williams et al. | 209/323 |
| 3,352,418 | 11/1967 | Swallow | 209/403 |
| 3,508,649 | 4/1970 | Kahane et al. | 209/403 X |
| 4,152,253 | 5/1979 | Summers | 209/323 X |

*Primary Examiner*—Joseph J. Rolla
*Assistant Examiner*—Gregory L. Huson
*Attorney, Agent, or Firm*—Ostrolenk, Faber, Gerb & Soffen

[57] ABSTRACT

This invention is concerned with an improved structure for the conventional vibro separator which features:

A. A novel sereen assembly structure: An additional coarse screen (2–16 mesh) is employed for supporting purpose. It will be secured on a special designed screen frame in order to keep the screen surface in a flat manner. And then the main screen (fine mesh) can be put flatly on coarse screen. It is to be fastened by folding and pressing tight the outside edge into the position between the flanges of spacing frames without using any bolt on welding.

B. A new designed ball tray assembly: A certain number of plastic rings are freely added in the ball tray as barriers to confine the tapping balls into certain groups in order to even distribute the tapping balls. And a simplified structure for ball tray assembling is designed with only putting the tray on the flange of lower spacing frame and to be held in position by the inner shoulder cutting space at the bottom of screen frame.

C. This invention shall have the following advantages.

1. The load of the gravity force of powder material and the ballbeating force will be over taken by the strong larger wire elements of the coarse screen to avoid any center deformation of the main screen.
2. The maintain the main screen a long life due to the support of the coarse screen.
3. Screen replacement will be easily completed within a few minutes.
4. The tapping efficiency will be increased to maximum.
5. Ball tray assembly work is to be simplified.

7 Claims, 4 Drawing Sheets

VIBRATORY SEPARTOR SCREEN ASSEMBLY

BACKGROUND OF THE INVENTION

There are many types vibro separators from single-stage onedirection vibrating type to multi-stage 3-dimensional vibrating type.

However, according to the information available, the inventor has found that all the current vibro separators have the following deficiencies in common:

1. Easily to deform with depression at the center part of the screen.
2. Ball-tapping separators are even fast-damaging.
3. Difficult for screen replacement. For example, the Japanese-made separators use quite a number of bolts and nuts to fasten the screen edge with a tension ring to an internal flange in the spacing frame. You have to disassemble and reassemble all the bolts and nuts during replacing which takes extra labor and time. As for the American-made separators, they fasten the screen to the screen frame by spot welding with a tension ring. Whenever you want to replace, you must change the screen and the frame together, resulting in additional cost.
4. Poor tapping efficiency. The tapping balls are always moved to concentrate on the outside surrounding area by the centrifugal force due to vibrating.
5. Difficult for ball &ray assembling and disassembling. There are a number of long bolts to be used to fasten the ball tray edge through the screen frame and lower spacing frame.

SPECIFIC DESCRIPTION OF THE DRAWINGS

Figure 1:
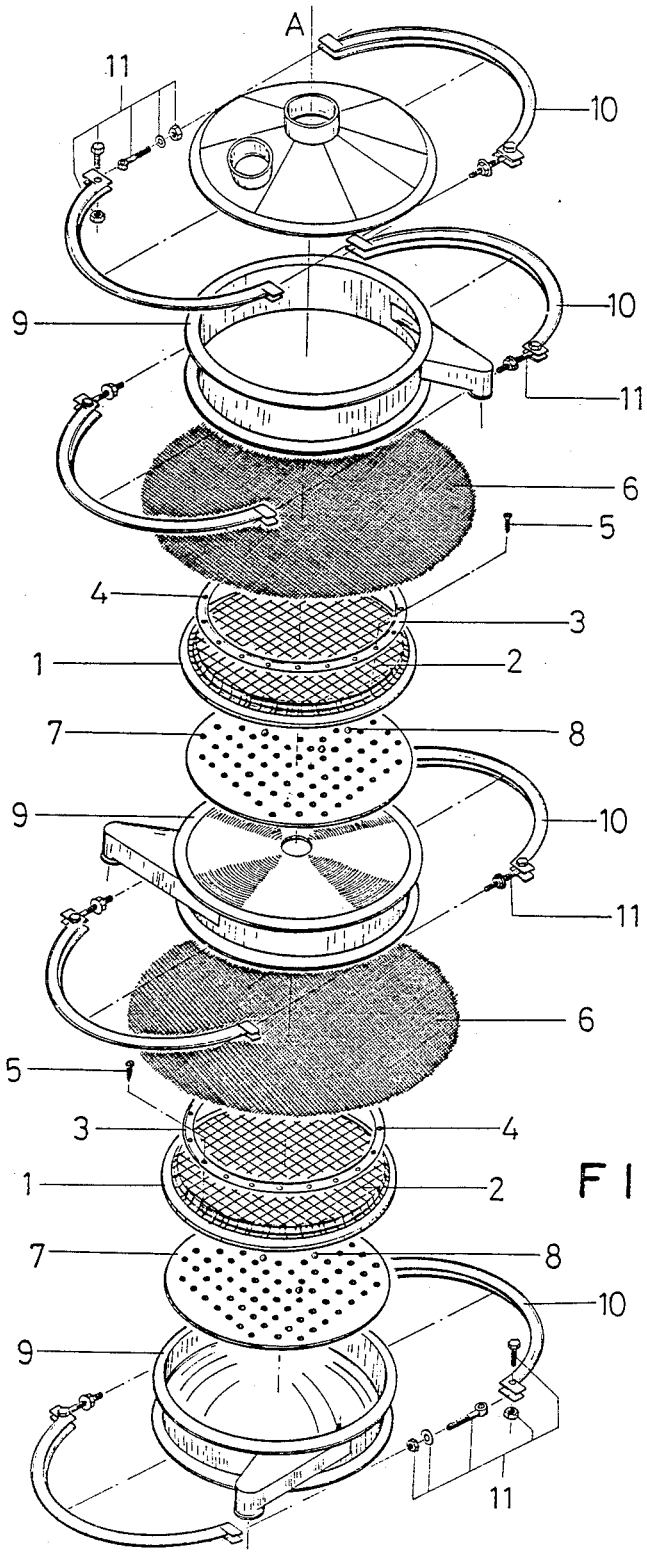
FIG. 1 is the schematic drawings of embodiment for a multi-stage 3-dimensional vibro separator used for this invention.

As shown in FIG. 1, The major parts of this invention and the parts related to fasten the major parts are as follows:

(1) Screen frame.
(2) Coarse screen (2-16 mesh).
(3) Round bar tension ring.
(4) Holes.
(5) Studs.
(6) Main screen (fine mesh).
(7) Ball tray.
(8) Tapping balls.
(9) Spacing frame.
(10)"V" clamp ring.
(11)"V" clamp ring fastening bolts.

Figure 2:
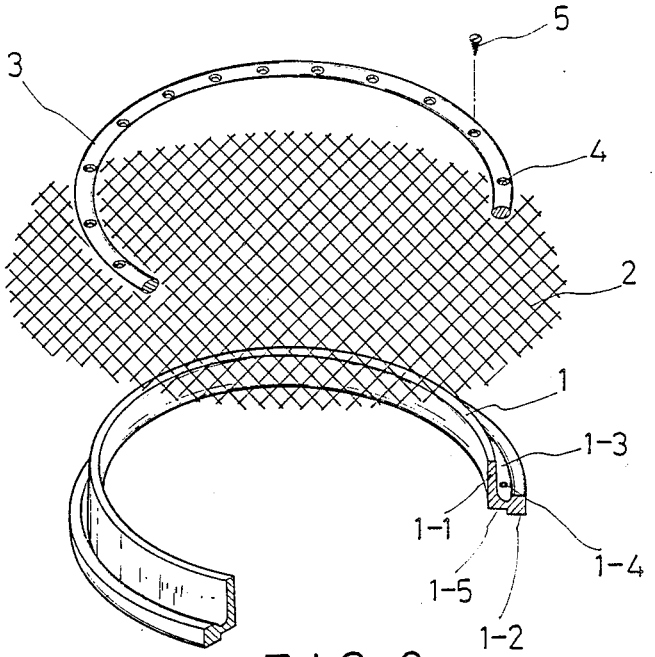
FIG. 2 is to show the method of fastening the coarse screen to the screen frame.

As shown in FIG. 2 is as follows:

(1) Screen frame, "L" cross section;
(1-1) The wall (Vertical part) of the screen frame;

(1-2) The flange (Horizontal part) of the screen frame;
(1-3) The half-rounded groove on the flange near by the wall of the frame;
(1-4) The thread holes in the groove (1-3) for studs (5);
(1-5) The inner shoulder cutting space at the bottom of the screen frame;
(2) Coarse screen;
(3) Rounded-bar tension ring;
(4) Holes in the ring;
(5) Studs;

In this figure, we can see that the outside surrounding part of the coarse screen (2) will be pressed down around the outside edge of the wall (1-1) into the groove (1-3) by the rounded bar tension ring and be fastened by the studs (5) through the hole (4) into the thread holes (1-4). Then the whole coarse screen and frame assembly has being completed.

With this designation, the top surface of the coarse screen is kept in a flat manner (the tension ring is not on the top of the frame). So that the main screen can be directly laid on the coarse screen and can be fully supported by it.

Figure 3:
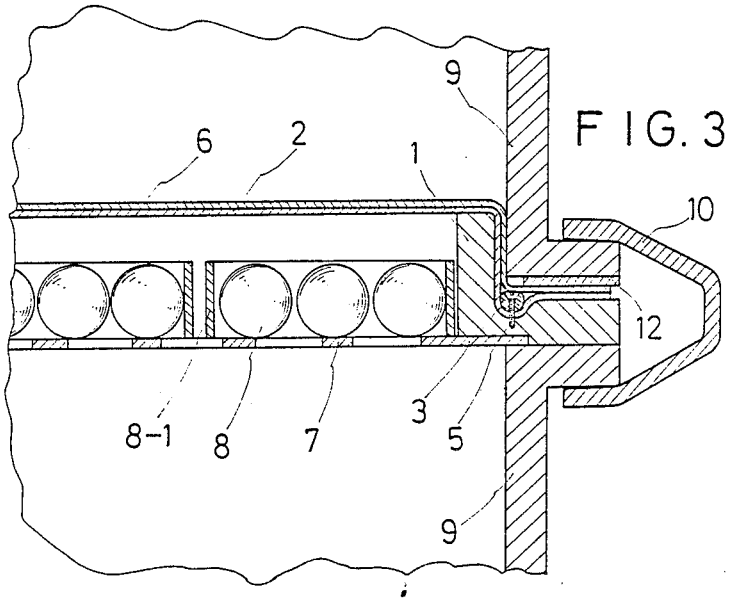
FIG. 3 is the structure drawing to show the final assembly of the major parts used for this invention.

As shown in FIG. 3, the main screen (6) will be directly laid on the top surface of the coarse screen (2) with the outside edge pressed and folded downward by the flange of upper spacing frame (9) and secured between a rubber cushion ring (12) and the flange of the screen frame (1-2) which will be combined together with the flange of lower spacing frame by the "V" clamp ring (10) and tighten up with two fastening bolts (11).

When the main screen (6) is to be replaced, just loosen the "V" clamp ring (10) and remove the upper spacing frame (9) and the rubber cushion ring (112). The replacement work can be easily completed within a few minute.

Figure 4:
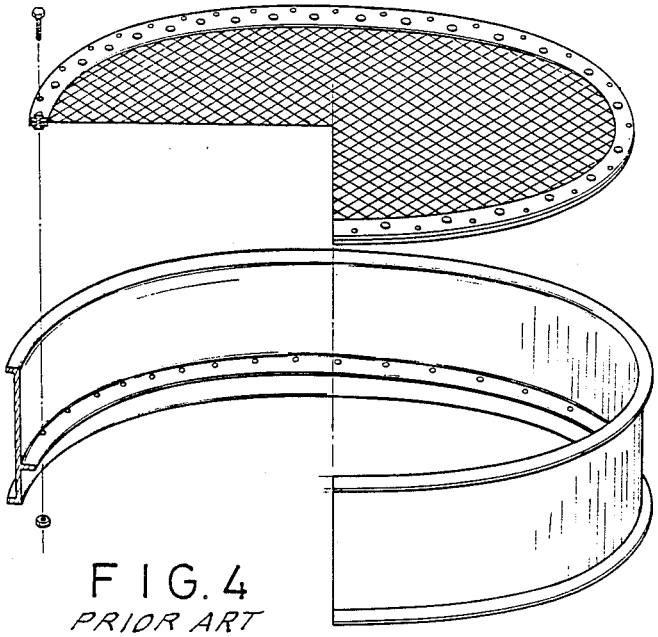
FIG. 4 PRIOR ART
FIGS. 4 and 5 are showing the screen fasten structures of conventional Japanese-made and U.S.-made separator respectively for reference.

FIG. 4 is to show the screen fasten structure of a Japanese-made separator for reference which uses many bolts and nuts to secure the screen resulting in much more labor and time for replacement.

Figure 5:
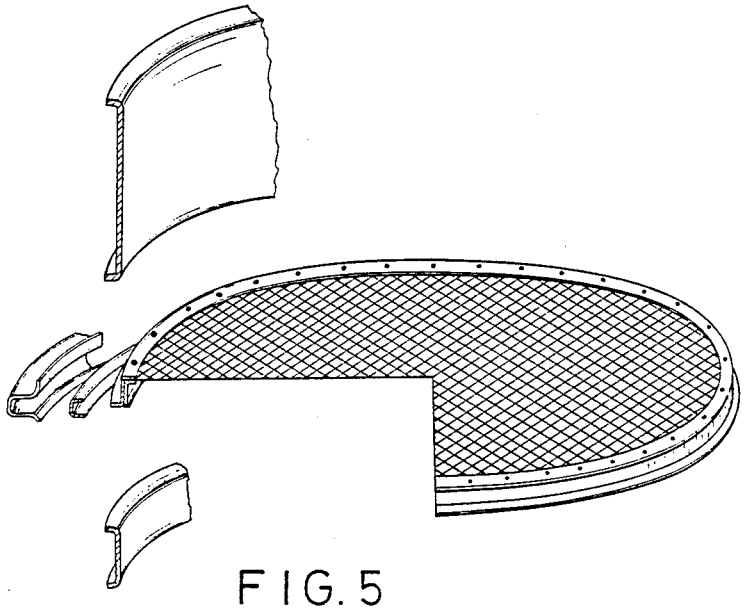
FIG. 5 PRIOR ART

FIG. 5 is the conventional US.-made separator which uses spot welding to secure the screen resulting in additional cost for replacement.

Judging from the shortcomings of the Japanese-made and U.S.-made separators, the advantages of the present invention should be apparently recognized.

Figure 6:
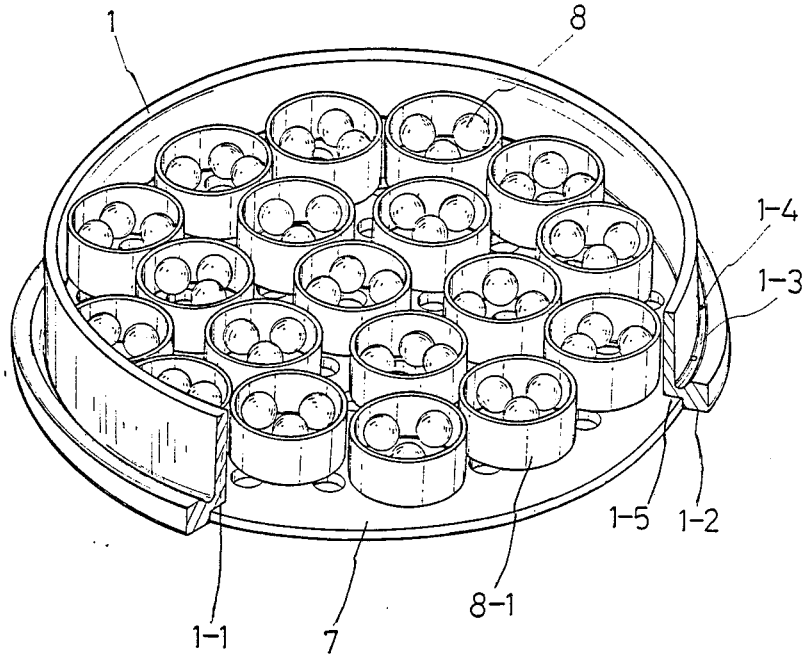
FIG. 6 is the schematic drawing of the new designed ball tray assembly.

As shown in FIG. 6, is as follows:

(1) Screen frame
(1-5) The inner shoulder cutting space at the bottom of the screen frame.
(7) Ball tray
(8) Tapping balls
(8-1) Plastic barrier rings
(9) Lower spacing frame.

In this FIG. 6. We can see the new designed plastic barrier rings (8-1) are employed for the purpose to confine the tapping balls (8) into groups. The height of the ring wall is designed to limit the balls (8) just can not jumping out from the ring (8-1). And the rings (8-1) can move freely on the ball tray (17) with the balls (8) enclosed. The number of rings (8-1) to be used is decided so as almost to full fill the whole area of ball tray (7) but not cloged their moving. The tapping operation will be even distributed all around the under surface of coarse screen (2). The outside edge of ball tray (7) is to be put on the flange of lower spacing frame and to be held in position by the inner shoulder cutting space at the bottom of screen frame. There are no bolts needed.

I claim:

1. A screen structure for vibratory separator comprising:

a screen frame for supporting screens, the screen frame including an upstanding wall having an upper edge and having a radially outwardly extending edge flange around the upstanding wall down from the upper edge of the screen frame;

a coarse screen placed atop the upper edge of the frame wall, and including a first peripheral edge portion wrapped down the outside of the frame wall and secured stretched tight to the edge flange of the screen frame, and attaching means attaching the coarse screen to the edge flange;

a main screen laid on top of the coarse screen and extending across the surface of the coarse screen, the main screen including a second peripheral edge portion which also extends down the outside of the upstanding wall of the screen frame on the outside of the coarse screen and then extends over the edge flange of the screen frame above the coarse screen on the edge flange, said main screen being removable from said screen frame while the coarse screen remains stretched tight and attached to the edge flange of the screen frame by the attaching means;

an upper spacing frame projecting above the screen frame and above the screens supported on the screen frame, and the upper spacing frame having a wall which extends down past and outside the wall of the screen frame down to the edge flange of the screen frame; the upper spacing frame having a first peripheral flange which extends radially outwardly from the wall thereof above the screens which are on the edge flange of the screen frame, and the upper frame being pressed down toward the edge flange of the screen frame for squeezing the screens between the first peripheral flange of the upper spacing frame and the edge flange of the screen frame;

a lower spacing frame disposed beneath and extending down from the edge flange of the screen frame, the lower spacing frame also including a second peripheral flange projecting radially outwardly and also disposed below the edge flange of the screen frame;

a V clamp ring extending around the periphery of the structure and around the first and second peripheral flanges, the clamp ring having legs which sandwich between them the first peripheral flange of the upper spacing frame and the second peripheral flange of the lower spacing frame and clamps the peripheral flanges together over the edge flange and the coarse screen and the main screen.

2. The structure of claim 1, wherein the first peripheral flange is at the bottom of the upper spacing frame and the second peripheral flange is at the top of the lower spacing frame.

3. The structure of claim 1, further comprising a groove defined on the top side of the edge flange of the screen frame inward toward the upstanding wall of the screen frame; the attaching means comprising a tension ring disposed on top of the coarse screen for urging the coarse screen into the groove and for tightening it into the groove for tightening the coarse screen over the screen frame and tensioning the coarse screen.

4. The structure of claim 3, wherein the attaching means further comprises studs extending through the tension ring into the edge flange of the screen frame for fastening the tension ring to the screen frame.

5. The structure of claim 1, further comprising a ball trap disposed below the coarse screen, and means at one of the frames for supporting the ball tray; a plurality of tapping balls disposed above the ball tray, and the ball tray having holes therethrough for permitting the passage therethrough of materials on the ball tray;

a plurality of barrier rings, each surrounding a plurality of the balls on the ball tray, and the number of barrier rings and the number of balls being selected for evenly distributing the balls across the tray without interfering with the movement of the rings and the balls across the tray for tapping.

6. The structure of claim 5, wherein the barrier rings are of a height beneath the coarse screen so as to prevent the balls from jumping over the walls while permitting the rings to move freely across the ball tray.

7. The structure of claim 5, further comprising the screen frame including an inner shoulder defined at the underside thereof for receiving the ball tray and the tray being shaped to be received at the inner shoulder; the second peripheral flange of the lower spacer frame extending beneath the ball tray disposed in the inner shoulder for holding the ball tray to the screen frame.

* * * * *